US007770555B2

(12) United States Patent
Matsuda

(10) Patent No.: US 7,770,555 B2
(45) Date of Patent: Aug. 10, 2010

(54) ENGINE COMBUSTION CONTROLLING METHOD, DEVICE AND MOTORCYCLE

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/528,484

(22) Filed: Sep. 26, 2006

(65) Prior Publication Data

US 2007/0068469 A1 Mar. 29, 2007

(30) Foreign Application Priority Data

Sep. 26, 2005 (JP) ..... 2005-277395

(51) Int. Cl.
*F02B 75/06* (2006.01)

(52) U.S. Cl. ..... 123/192.2; 123/514

(58) Field of Classification Search ..... 123/198, 123/59, 198 R, 514, 192.2; 73/119, 117.3, 73/114.41, 112.01; 192/53.1, 69.1
See application file for complete search history.

(56) References Cited

U.S. PATENT DOCUMENTS 4,250,850 A * 2/1981 Ruyer ..... 123/198 F
4,327,811 A 5/1982 Isaka
4,417,469 A * 11/1983 Stevenson et al. ..... 73/119 A
5,271,229 A * 12/1993 Clarke et al. ..... 60/605.1
5,613,473 A * 3/1997 Angermaier ..... 123/481
5,871,002 A * 2/1999 Nada ..... 123/609
6,050,231 A 4/2000 Tisch et al.
6,170,322 B1 * 1/2001 Yamazaki et al. ..... 73/117.3
6,952,923 B2 * 10/2005 Branyon et al. ..... 60/597
7,216,634 B2 * 5/2007 Hayasaka et al. ..... 123/514
7,243,627 B2 * 7/2007 Izumi et al. ..... 123/90.17
2007/0113829 A1 * 5/2007 Allen ..... 123/492

FOREIGN PATENT DOCUMENTS

EP 1398482 3/2004
JP 62-099627 5/1987

OTHER PUBLICATIONS

ISA Europe; International Search Report of EP06254967; Jan. 22, 2009; EPO.

* cited by examiner

*Primary Examiner*—Stephen K Cronin
*Assistant Examiner*—Keith Coleman
(74) *Attorney, Agent, or Firm*—Alleman Hall McCoy Russell & Tuttle LLP

(57) ABSTRACT

A method, a device utilizing the method, and a motorcycle equipped with the device are provided, of controlling combustion of an engine to have an engine beat different from an equally-intervalled combustion. The method of controlling combustions of an engine having three or more pistons of cylinders per crankshaft includes causing simultaneous combustions of two cylinders among the three or more cylinders, the two cylinders having the same crank phase angle, causing a combustion of at least one -other cylinder, and in the process of said combustion offsetting a crank phase angle by a first crank phase angle, and repeating from the combustions of the first two cylinders further offsetting the crank phase angle by a second crank phase angle from the first crank phase angle.

16 Claims, 12 Drawing Sheets

ENGINE COMBUSTION CONTROLLING METHOD, DEVICE AND MOTORCYCLE

CROSS-REFERENCE TO RELATED APPLICATION

The present application claims priority from Japanese Patent Application No. 2005-277395 filed Sep. 26, 2005, which is hereby incorporated by reference in its entirety for all purposes.

TECHNICAL FIELD

The present invention relates to a method and device of controlling combustions of an engine, and to a motorcycle equipped with the device, for improving a passenger's feel of an engine beat.

BACKGROUND

For example, an inline-four-cylinder engine is configured to support pistons of four cylinders per crankshaft. In the engine of such a configuration, there are some which adopt a flat crankshaft (see Examined Japanese Patent Publication No. HEI 7-26546, for example).

The flat crankshaft is referred to as such because the phase angles of crank pins of the crankshaft (that is, crank phase angles) are arranged at 0 or 180 degrees. For example, No. 1 and No. 4 cylinders are in the same crank phase angle, and with respect to the crank phase angles of these cylinders, the crank phase angles of No. 2 and No. 3 cylinders are configured to be apart from the crank phase angles of No. 1 and No. 4 cylinders by 180 degrees.

Generally, in an engine which adopts such a flat crankshaft, a combustion control called "equally-intervalled combustion" may be carried out. The equally-intervalled combustion for the flat crankshaft is such that combustions of cylinders are sequentially carried out one by one as the crankshaft rotates every 180 degrees. For example, a combustion of No. 1 cylinder (#1) is carried out when the crank phase angle is 0 degrees, a combustion of No. 2 cylinder (#2) is carried out when the crank phase angle is 180 degrees, a combustion of No. 4 cylinder (#4) is carried out when the crank phase angle is 360 degrees, and a combustion of No. 3 cylinder (#3) is carried out when the crank phase angle is 540 degrees, so that a predetermined rhythm (feel of an engine beat) is produced.

However, the feel of the engine beat of equally-intervalled combustion is monotonous to the passenger. The feel of the engine beat is important because it dictates a ride quality and, thus, a development of an engine with a more comfortable feel of the engine beat has been always demanded.

DESCRIPTION OF THE INVENTION

The present invention is to address the above conditions, and to provide a method and device, and a motorcycle equipped with the device, of controlling combustion of an engine with a more comfortable feel of an engine beat.

According to one aspect of the present invention, a device for controlling combustions of an engine with three or more pistons of cylinders per crankshaft is provided. The device includes a first module for causing simultaneous combustions of two cylinders among the three or more cylinders, that have the same crank phase angle, and a second module for causing a combustion of at least one of the other cylinders, and in the process of said combustion offsetting a crank phase angle by a first crank phase angle, wherein the first module repeats the combustions from the first two cylinders, further offsetting the crank phase angle by a second crank phase angle.

In one aspect of the invention, it is possible to obtain a feel of an engine beat that is different from the equally-intervalled combustion, because combustions of two cylinders having the same crank phase angle among three or more cylinders are carried out, that is, the simultaneous combustion is carried out.

The crankshaft may be a flat crankshaft which crank phase angles are 0 and 180 degrees. Thus, a torque during the simultaneous combustion is approximately doubled, and a larger and sharper feel of the engine beat can be obtained.

For example, in the case of an inline-four-cylinder engine having a flat crankshaft, it is preferable that the first crank phase angle is 180 degrees, and the second crank phase angle is 540 degrees.

In the case of an engine with pistons of four cylinders per crankshaft, that is, an inline-four-cylinder engine, and where the crankshaft is a flat crankshaft, two cylinders in which combustion is simultaneously carried out by the first module may have the same crank phase angle for each other, and two remaining cylinders may also have the same crank phase angle for each other. However, these cylinder pairs may be offset by 180 degrees in the crank phase angle relative to each other. For this reason, if the simultaneous combustion of both cylinder pairs is carried out, an even larger and sharper feel of the engine beat can be obtained. Further, it is possible that combustion of one cylinder of one cylinder pair may be carried out while offsetting the crank phase angle by 180 degrees from that of the first module, and combustion of a remaining cylinder of this cylinder pair may be carried out while offsetting the crank phase angle by 360 degrees. Thus, a milder feel of the engine beat than when the simultaneous combustion of this cylinder pair is carried out can be obtained.

In the case that the engine is configured to control combustion of a corresponding cylinder based on a rotational angle position of a camshaft of the engine detected by a cam sensor with which the engine is equipped, if a detection point of the cam sensor is formed in a rotational angle position on the camshaft other than a rotational angle position corresponding to a timing in which cams on the camshaft, corresponding to the cylinders in which the simultaneous combustion is carried out, contact tappets, the detection of the cam sensor may not be carried out when the cams of the cylinder in which the simultaneous combustion is carried out operate the tappets and, thus, the detection of the cam sensor is stabilized.

The combustion control device for an engine as described above may be suitable for a motorcycle equipped with the following exhaust pipes.

For example, a configuration in which exhaust pipes connected to the cylinders with the same crank phase angle is collected may be possible. In this case, an exhaust pulsation of non-180 degrees can be utilized and, thus, a motorcycle, that is powerful, and depending on a collected position, is possible to reduce a torque depression between torque peaks of each cylinder so that the entire torque fluctuation is smooth, can be realized.

Further, for example, a configuration in which exhaust pipes connected to cylinders that differ 180 degrees in the crank phase angle, respectively are collected, may be possible. In this case, an exhaust pulsation of 180 degrees can be utilized and, thus, a powerful motorcycle with a sharp torque peak can be realized.

Further, if every two exhaust pipes are to be collected, and collected positions of these exhaust pipe pairs are differed in the longitudinal direction of the exhaust pipes, it is possible to effectively utilize an exhaust pulsation of 180 degrees, reduce a depression of the torque between the torque peaks of each cylinder, and smooth the entire torque fluctuations.

Further, a configuration in which the collected exhaust pipes are further collected with the other exhaust pipes connected to cylinders having the same crank phase angle or a different crank phase angle by 180 degrees may also be possible. In this case, a result in which the functions and effects as mentioned above are combined can be obtained.

According to another aspect of the present invention, a method of controlling combustions of an engine having three or more pistons of cylinders per crankshaft is provided. The method includes causing simultaneous combustions of two cylinders among the three or more cylinders, that have a same crank phase angle, causing a combustion of at least one another cylinder and in the process of said combustion offsetting a crank phase angle by a first crank phase angle, and repeating from the combustions of the first two cylinders further offsetting the crank phase angle by a second crank phase angle from the first crank phase angle.

BRIEF DESCRIPTION OF THE DRAWINGS

The disclosure is illustrated by way of example and not by way of limitation in the figures of the accompanying drawings, in which the like reference numerals indicate similar elements and in which.

DETAILED DESCRIPTION

Hereafter, a method and device of controlling combustion of an engine according to the present invention, and a motorcycle equipped with the combustion control device will be explained in detail, referring to the appended drawings.

Figure 1:
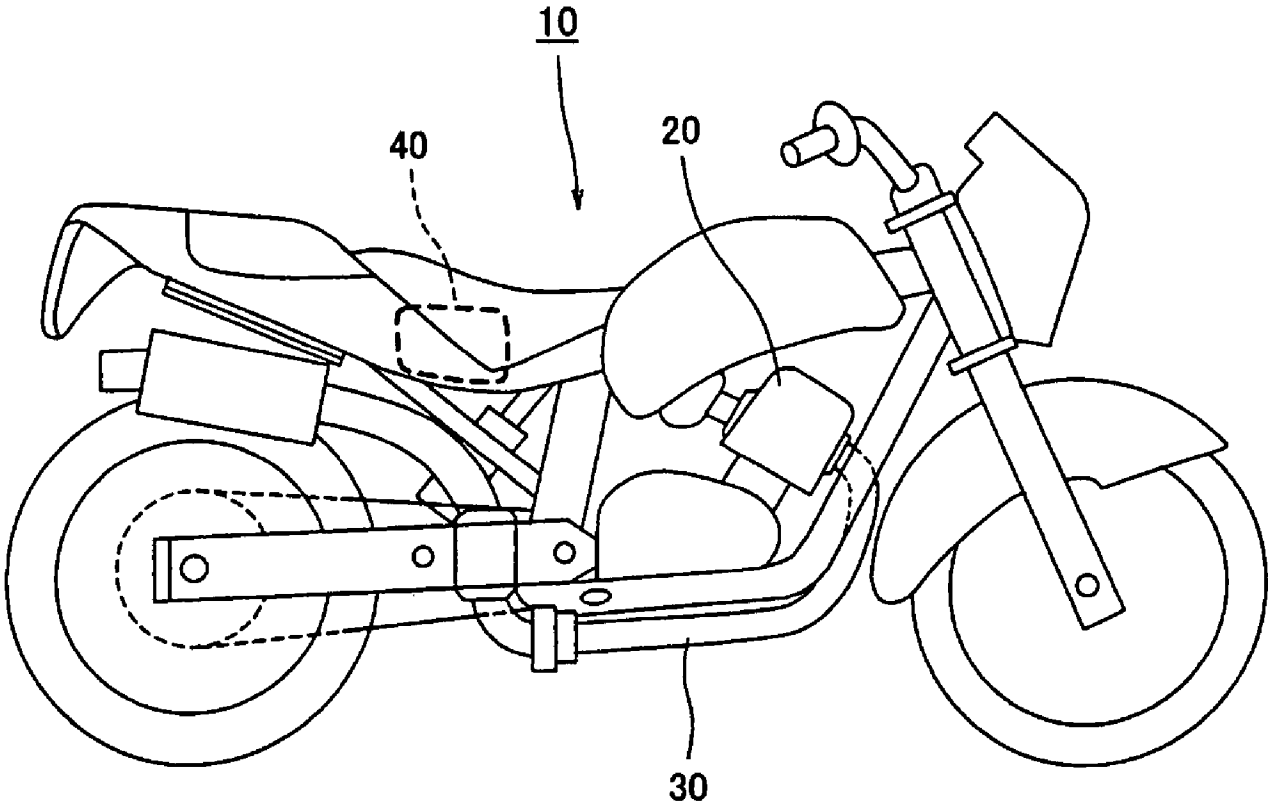
FIG. 1 is a schematic view from the right side, showing a configuration of a motorcycle according to an embodiment of the present invention.

FIG. 1 is a view showing a motorcycle 10 according to an embodiment of the present invention. The motorcycle 10 according to the embodiment includes an inline-four-cylinder engine 20 as its drive source. However, this drive source may be, but is not limited to, other engines having a configuration in which pistons of three or more cylinders are supported by one crankshaft, such as V3, V8 engines, etc.

As shown in FIG. 1, exhaust pipes 30 are connected to exhaust ports (not shown) of the engine 20. Further, the motorcycle 10 includes an ECU (Electronic Control Unit) 40 as the combustion control device for controlling combustions of the engine 20.

Figure 2B:
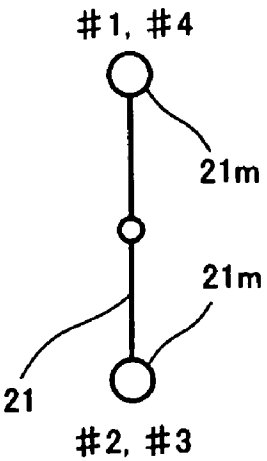
FIG. 2B is a side view of FIG. 2A.
Figure 2A:
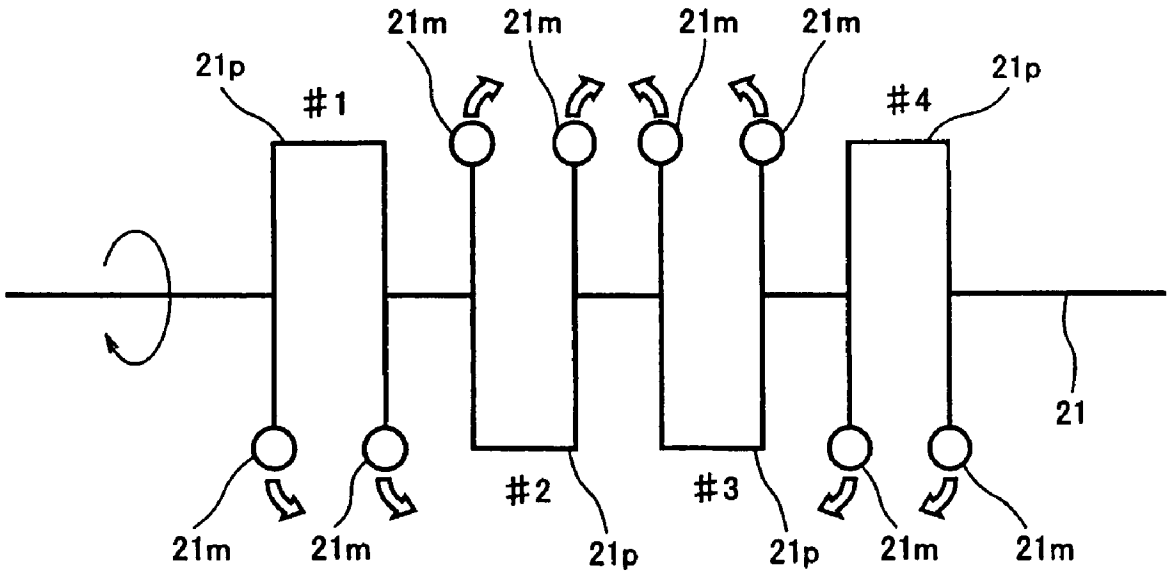
FIG. 2A is a schematic view showing a configuration of a crankshaft of an engine of the motorcycle shown in FIG. 1.

As FIG. 2A schematically shows in an example of a crankshaft 21 of the engine 20, and FIG. 2B shows in a side view thereof, this crankshaft 21 is a flat crankshaft in which phase angles of crank pins 21*p* of the crankshaft (crank phase angles) are arranged at 0 and 180 degrees. In this embodiment, the crank phase angles of No. 1 cylinder (#1) and No. 4 cylinder (#4) of this crankshaft 21 are both arranged at the position of 0 degrees. Further, the crank phase angles of No. 2 cylinder (#2) and No. 3 cylinder (#3) are also both arranged at the position of 180 degrees.

In a typical engine, balance weights are provided opposite to the crank pin 21*p* of each cylinder so that inertia of a piston and a connecting rod (not illustrated) which are attached to the crank pin 21*p* is cancelled out. However, for example, in the four-cylinder flat crankshaft as shown in FIGS. 2A and 2B, since there are the same number of cylinder pairs with opposite crank phase angles, it is possible to cancel the inertia of the pistons and the connecting rods for each other even if the balance weights are not provided.

In this embodiment, as shown in FIG. 2A, although the balance weights 21*m* are provided, these balance weights 21*m* are not necessary because a bending moment acting on the crankshaft 21 generated by the balance weights 21*m* arranged on the left and right side of a center position between No. 2 cylinder (#2) and No. 3 cylinder (#3) can be cancelled out.

That is, in the case of a flat crankshaft that includes three or more and even number of pistons of cylinders per crankshaft 21, since the balance weights are not necessary, it is advantageous to reduce weight.

Figure 3:
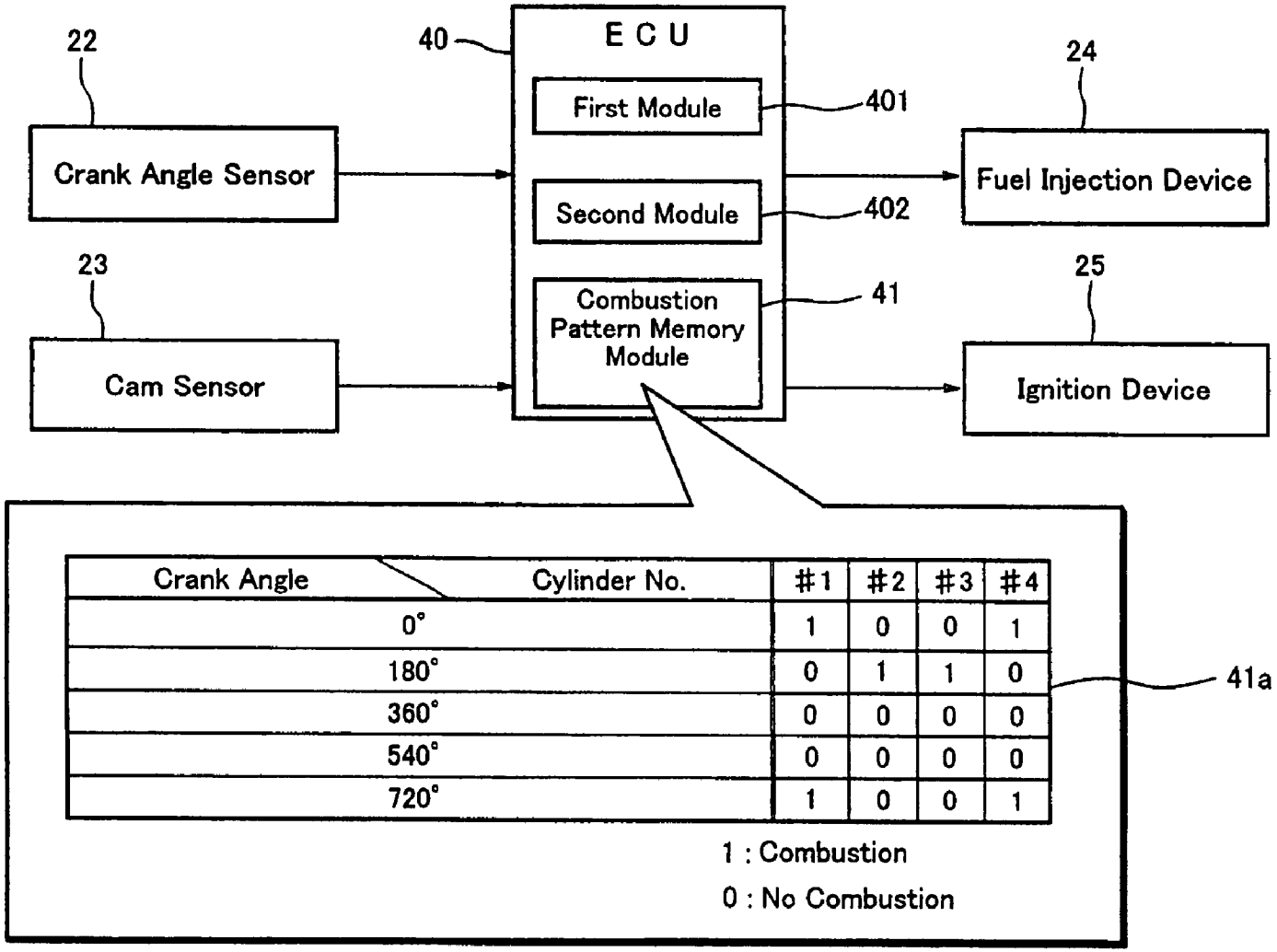
FIG. 3 is a block diagram showing a configuration of a combustion control device of the motorcycle shown in FIG. 1.

As shown in FIG. 3, an ECU 40 as the combustion control device according to the embodiment is connected to a crank angle sensor 22, a cam sensor 23, a fuel injection device 24, and an ignition device 25, of the engine 20.

The crank angle sensor 22 typically outputs a pulse signal corresponding to a rotational angle position of the crankshaft 21. The cam sensor 23 outputs a pulse signal corresponding to the rotational angle position of a camshaft 26 (see FIG. 10).

ECU 40 calculates the rotational angle position of the crankshaft 21 (that is, the crank phase angle) based on the pulse signal outputted from the crank angle sensor 22 and the cam sensor 23, respectively. In the meantime, in this embodiment, although it is configured so that the crank phase angle is calculated using both the crank angle sensor 22 and the cam sensor 23, it may also be possible to carry out a similar calculation using either one of the crank angle sensor or the cam sensor 23.

Further, ECU 40 includes a combustion pattern memory module 41. The combustion pattern memory module 41 stores a combustion pattern 41*a* that indicates which cylinder is to carry out a combustion in accordance with the crank phase angle. The combustion pattern 41*a* shown in FIG. 3 is merely an example, and it is appreciated that other combustion patterns may be used in a similar manner. In the combustion pattern 41*a* shown in FIG. 3, whether or not a combustion is to be carried out for each cylinder at a predetermined crank phase angle is represented by "1" or "0".

ECU 40 refers to the combustion pattern 41*a* stored in the combustion pattern memory module 41 based on the crank phase angle calculated as mentioned above, and specifies the corresponding target cylinder for combustion. ECU 40 then outputs an instruction to the fuel injection device 24 and/or the ignition device 25 corresponding to the specified target cylinder for the combustion, and carries out the combustion of the target cylinder.

In more detail, ECU 40 includes a first module 401 for carrying out simultaneous combustions of two cylinders that have the same crank phase angle, based on the combustion pattern 41*a*, and a second module 402 for carrying out a combustion of at least one of the other cylinders (for example, two other cylinders) offsetting the crank phase angle by a first crank phase angle (for example, 180 degrees), based on the combustion pattern 41*a*, wherein ECU 40 is configured so that it controls the engine to repeats from the combustions of the first two cylinders further offsetting the crank phase angle by a second crank phase angle.

Figure 3A:
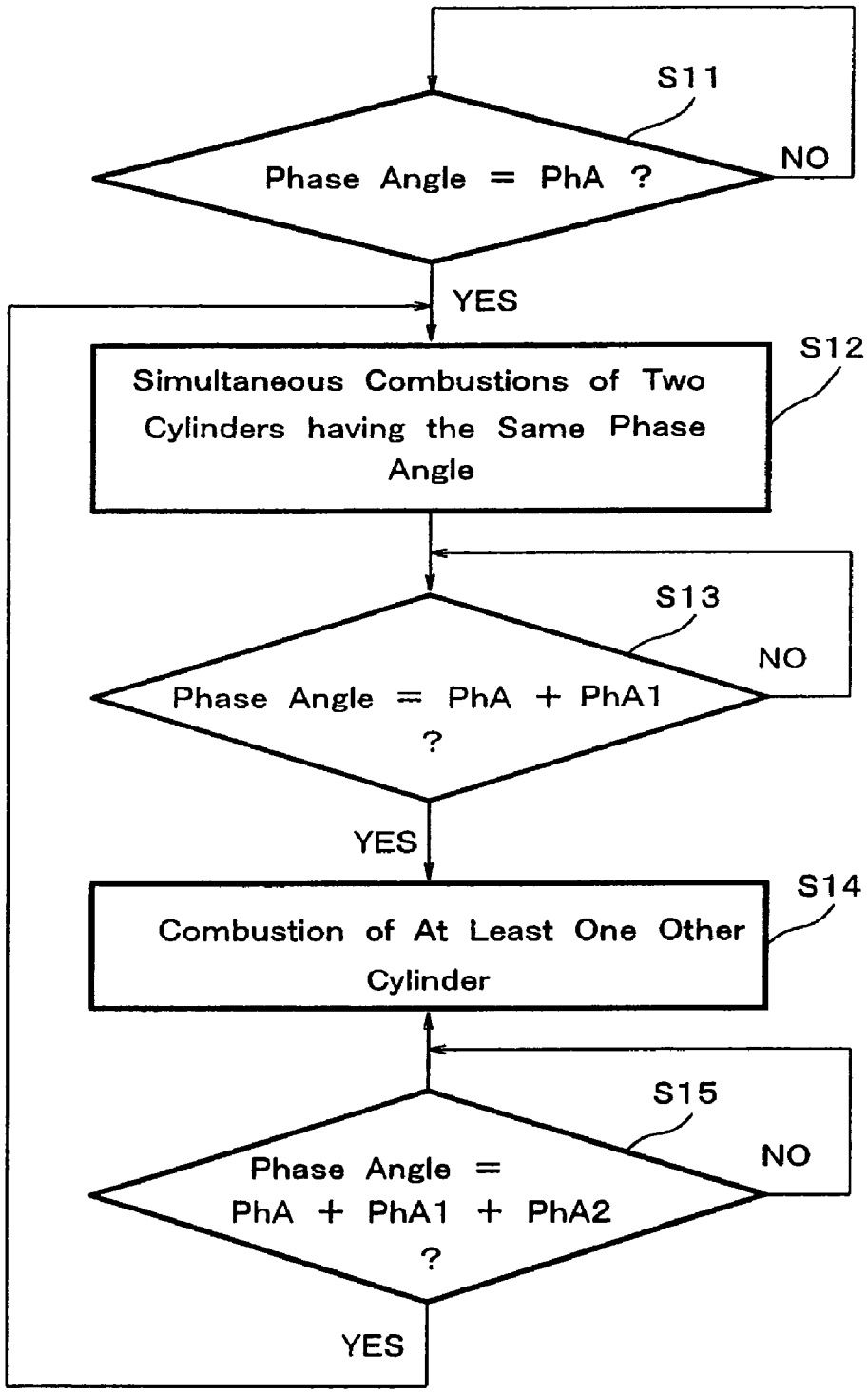
FIG. 3A is a flowchart showing an example of the engine combustion control of ECU shown in FIG. 3.

With reference to a flowchart in FIG. 3A, ECU 40 first determines whether the crank phase angle is a predetermined crank phase angle PhA (Step S11), and repeats Step S11 until the crank phase angle becomes the predetermined crank phase angle PhA. When ECU 40 determines that the crank phase angle is the predetermined crank phase angle PhA, then it causes the first module 401 to carry out simultaneous combustions of two cylinders that have the same crank phase angle, based on the combustion pattern 41*a* (Step S12).

Next, ECU 40 determines whether the crank phase angle is offset by a first crank phase angle PhA1 from the predetermined crank phase angle PhA (Step S13), and repeats Step S13 until the crank phase angle becomes PhA+PhA1. When ECU 40 determines that the crank phase angle is PhA+PhA1, then it causes the second module 402 to carry out a combustion of at least one of the other cylinders, based on the combustion pattern 41*a* (Step S14).

ECU 40 determines whether the crank phase angle is further different by a second crank phase angle PhA2 (Step S15), and repeats Step S15 until the crank phase angle becomes PhA+PhA1+PhA2. When ECU 40 determines that the crank phase angle is PhA+PhA1+PhA2, then it returns to Step S12 again to cause the first module 401 to repeat the combustions of the first two cylinders based on the combustion pattern 41*a*.

In this embodiment, since the engine 20 is four-cycle engine, the combustion pattern 41*a* is described with reference to, but is not limited to, a 720 degree basis through which the crankshaft 21 revolves for one combustion cycle.

Figure 4A:
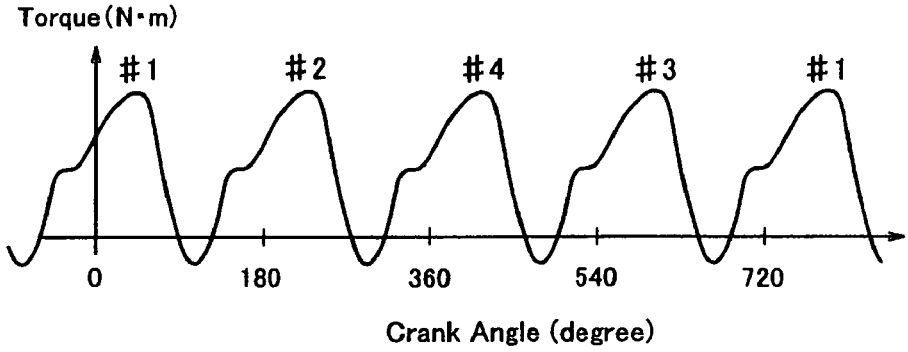
FIG. 4A is a graph showing a conventional combustion control pattern of an equally-intervalled combustion.

If the combustion/non-combustion for each cylinder is represented as a waveform of the output torque of the engine 20 with respect to the crank phase angle (crank angle), the equally-intervalled combustions may be as shown in FIG. 4A. For example, when the crank phase angle is 0 degrees, No. 1 cylinder (#1) carries out a combustion, No. 2 cylinder (#2) when 180 degrees, No. 4 cylinder (#4) when 360 degrees, No. 3 cylinder (#3) when 720 degrees, and it repeats from a combustion of No. 1 cylinder (#1) since one combustion cycle is completed.

Figure 4B:
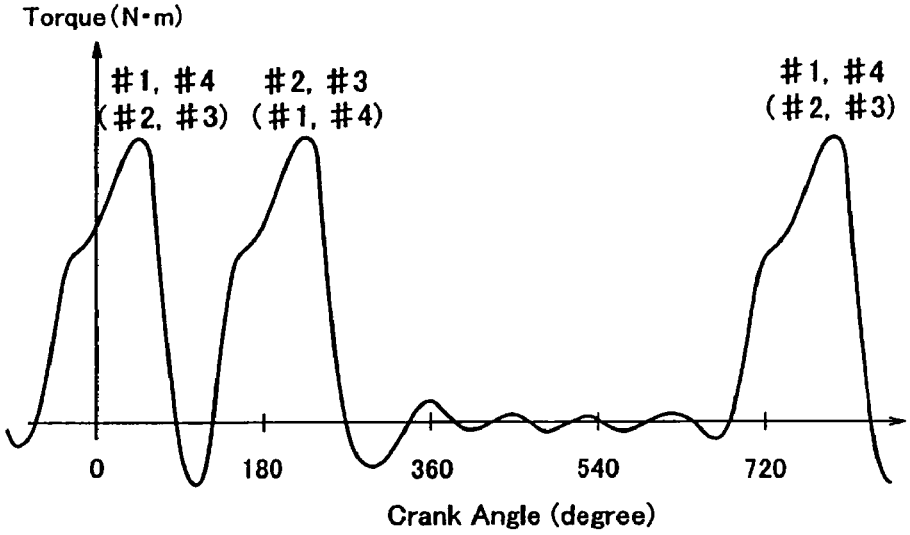
FIG. 4B is a graph showing an example of a combustion control pattern of a simultaneous combustion by the combustion control device shown in FIG. 3.

In contrast, the combustion pattern 41*a* of this embodiment may be as shown in FIG. 4B, for example. In the combustion pattern of FIG. 4B, No. 1 and No. 4 cylinders (#1, #4) carry out combustions when the crank phase angle is 0 degrees, No. 2 and No. 3 cylinders (#2, #3) when 180 degrees, no combustion is carried out for any cylinder when 360 and 540 degrees, and it repeats combustions from No. 1 and No. 4 cylinders (#1, #4).

Referring also to FIGS. 2A and 2B, this combustion pattern is a combustion pattern of what is called "a simultaneous combustion" in which combustions are simultaneously carried out for cylinders having the same crank phase angle. In the example of FIG. 4B, the simultaneous combustions are subsequently carried out at 0 and 180 degrees.

Since the engine 20 of this embodiment utilizes the flat crankshaft, it may also be possible to carry out a combustion pattern as shown by parentheses in FIG. 4B. That is, it is a combustion pattern in which No. 2 and No. 3 cylinders (#2, #3) carry out combustions when the crank phase angle is 0 degrees, No. 1 and No. 4 cylinders (#1, #4) at 180 degrees, no combustion is carried out for any cylinder at 360 and 540 degrees, and it repeats from combustions of No. 2 and No. 3 cylinders (#2, #3).

Figure 4C:
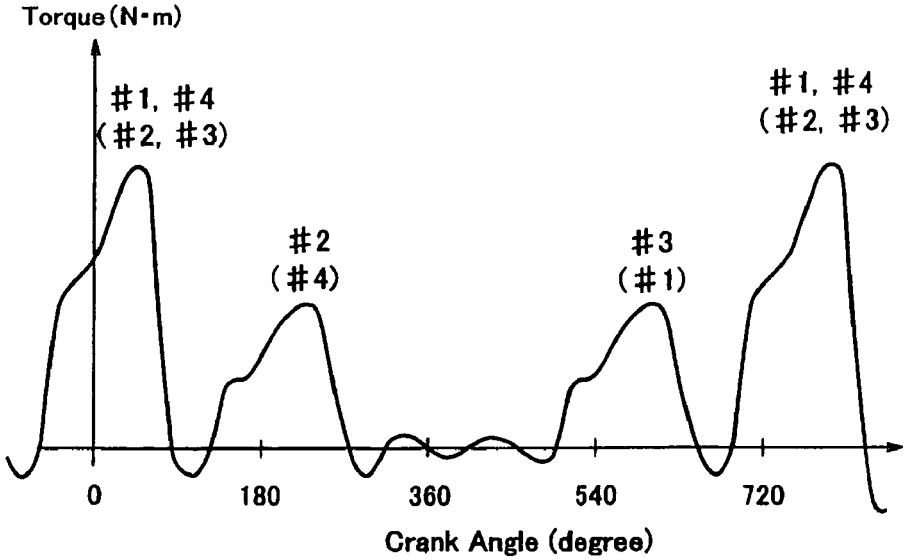
FIG. 4C is a graph showing another example of a combustion control pattern of the simultaneous combustion by the combustion control device shown in FIG. 3.

Further, a combustion pattern as shown in FIG. 4C may also be possible. That is, it is a combustion pattern in which No. 1 and No. 4 cylinders (#1, #4) carry out combustions when the crank phase angle is 0 degrees, No. 2 cylinder (#2) at 180 degrees, no combustion is carried out for any cylinder at 360 degrees, No. 3 cylinder (#3) at 540 degrees, and it repeats combustions from No. 1 and No. 4 cylinders (#1, #4).

Alternatively, as shown by parentheses in FIG. 4C, a combustion pattern in which No. 2 and No. 3 cylinders (#2, #3) carry out combustions when the crank phase angle is 0 degrees, No. 4 cylinder (#4) at 180 degrees, no combustion is carried out for any cylinder at 360 degrees, No. 1 cylinder (#1) at 540 degrees, and it repeats combustions from No. 2 and No. 3 cylinders (#2, #3) may also be possible.

According to the combustion pattern of such a simultaneous combustion, the torque peaks of the engine 20, that are transmitted to a tire, are unequally pitched. Thus, since the output torque generated by one combustion becomes larger, it tends to repeat an alternation between slip and grip of the tire on a road surface and, thereby obtaining a larger traction. Further, a skid becomes smaller under the influence of the larger traction even when the motorcycle 10 goes into a corner.

Further, an exhaust sound is comparatively shrill in the equally-intervalled combustion, however, in the simultaneous combustion, the exhaust sound is at a lower frequency, and of non-equal intervals, and, thus, it is possible to give passenger(s) a different feel of the engine beat from that of the equally-intervalled combustion. In the meantime, it is noted that not only the exhaust sound, but also vibrations of the engine 20 may affect to the passenger(s) in a similar manner.

Further, an exhaust pipe assembly 30 to be connected to the engine 20 that is subject to such combustion control may take the following configurations.

Figure 5A:
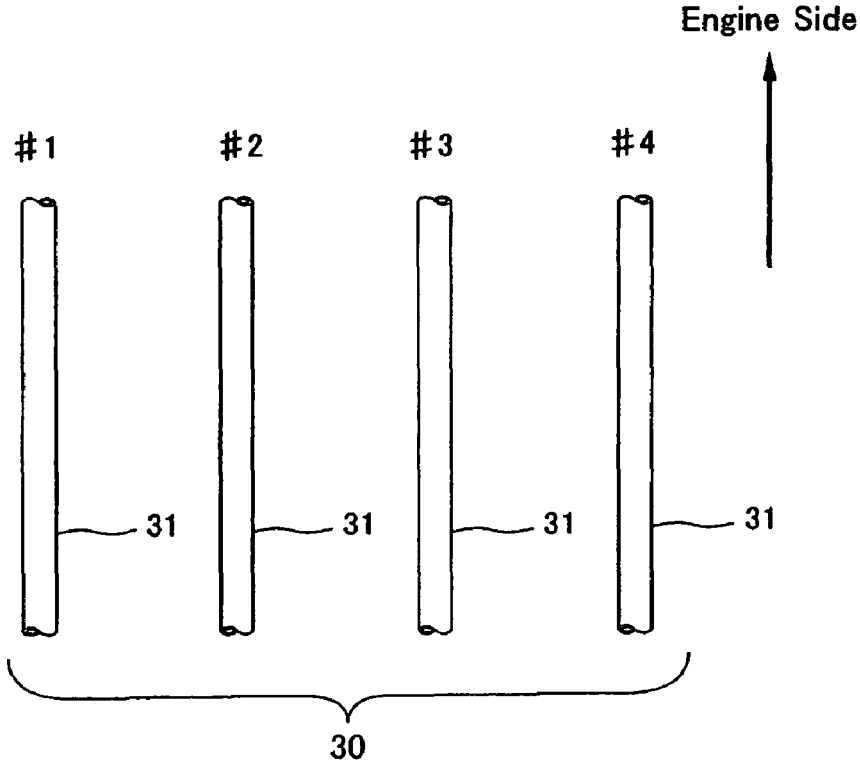
FIG. 5A is a schematic view showing an example of a configuration of exhaust pipes suitable for the engine of the motorcycle shown in FIG. 1.

For example, as shown in FIG. 5A, the exhaust pipe assembly 30 may be configured so that it includes independent exhaust pipes 31, each of which connected to each of the exhaust ports (not shown) of each cylinder of the engine 20.

In the meantime, in FIGS. 5A and 5B, FIGS. 6A and 6B, and FIG. 8, the exhaust pipes are connected to the exhaust ports of the engine 20 at an upper side, and only the direction is shown in each figure.

Figure 5B:
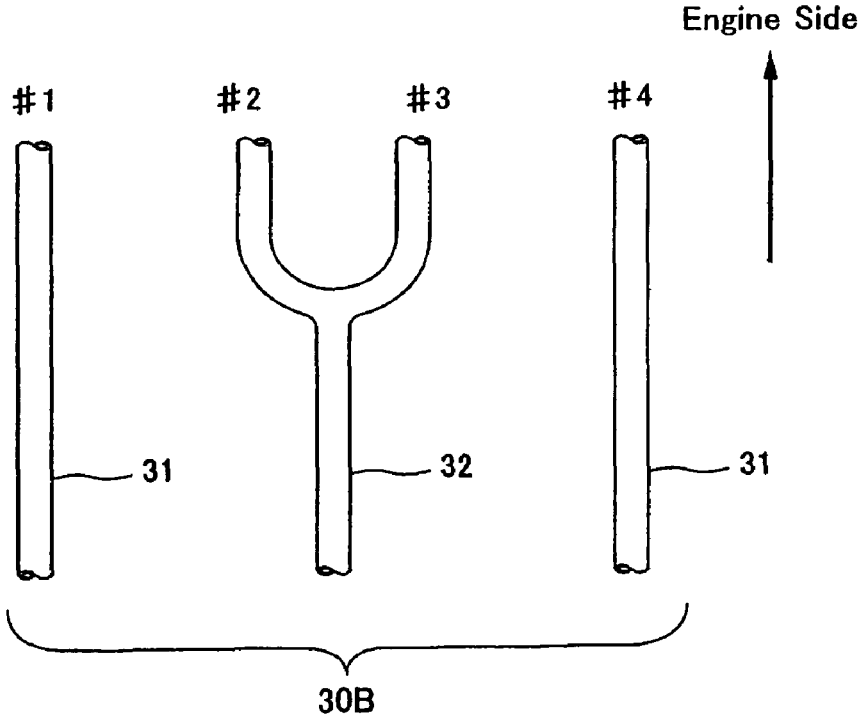
FIG. 5B is a schematic view showing another example of a configuration of the exhaust pipes suitable for the engine of the motorcycle shown in FIG. 1.

Further, an exhaust pipe assembly 30B of another example shown in FIG. 5B is configured such that No. 2 and No. 3 cylinders (#2, #3) that carry out the simultaneous combustions and are connected to a collecting pipe 32 that is collected in an intermediate position, and the remaining cylinders are connected to the straight exhaust pipes 31 as similar to that shown in FIG. 5A. According to this configuration, since the cylinders that carry out the simultaneous combustions are collected, exhaust pulsations of non-180 degrees can be utilized, even if any of the combustion patterns (including the pattern in the parentheses) in FIG. 4B or the combustion pattern in the parentheses in FIG. 4C are utilized. That is, although a torque will be greater than the case in FIG. 5A, without doing anything, a torque peak will be sharp. Thus, it is desirable to offset the torque phase angle so that the torque peaks of the entire engine are smooth and mild in a torque characteristic. This may be adjusted according to the collected position of the exhaust pipes (see FIG. 6A).

Figure 6A:
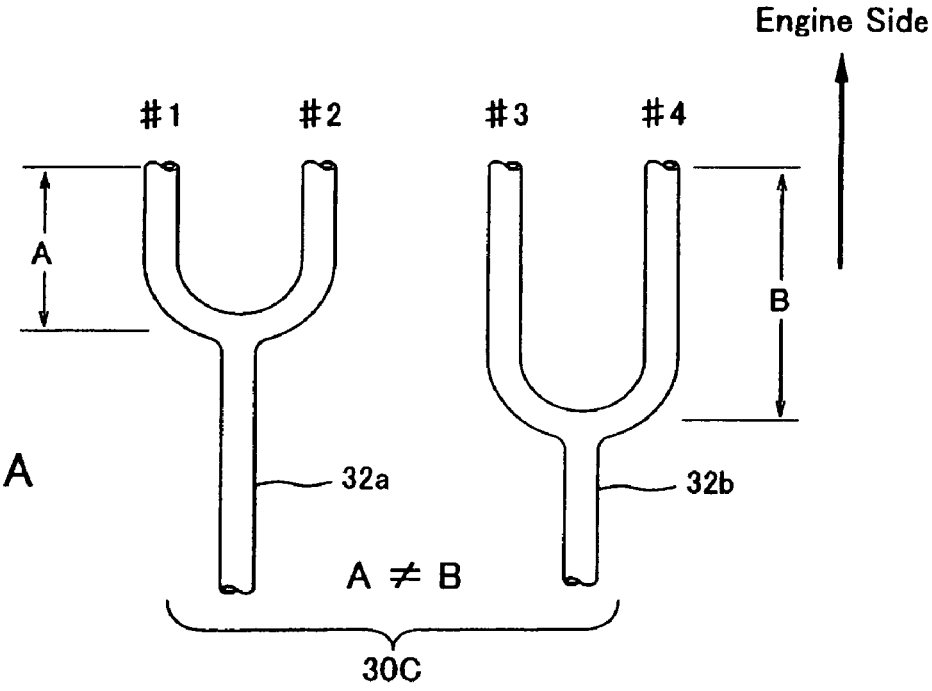
FIG. 6A is a schematic view showing still another example of a configuration of the exhaust pipes suitable for the engine of the motorcycle shown in FIG. 1.

Further, another example of an exhaust pipe assembly 30C shown in FIG. 6A has a configuration that a collecting pipe 32*a* is connected to No. 1 and No. 2 cylinders (#1, #2) that do not carry out out the simultaneous combustion, and a collecting pipe 32*b* is connected to No. 3 and No. 4 cylinders (#3, #4) that do not carry out the simultaneous combustion. According to this configuration, since the cylinders that do not carry out the simultaneous combustions are collected, the 180-degree exhaust pulsations can be utilized even for either of the combustion patterns of FIGS. 4B and 4C. That is, a larger torque can be obtained although a torque peak is sharper than the case of FIG. 5B.

In order to make the torque peaks of the entire engine smooth and mild by offsetting the torque phase angles, as further shown in FIG. 6A, it may be adjusted by offsetting the collected position of the collecting pipe 32*a* (for example, the position shown by "A" in the figure) and the collected position of the collecting pipe 32*b* (for example, the position shown by "B" in the figure) (that is, "A≠B") in the longitudinal direction of the pipes. In the meantime, in this embodiment, the collected positions are shown as distances from the respective exhaust ports.

Figure 6B:
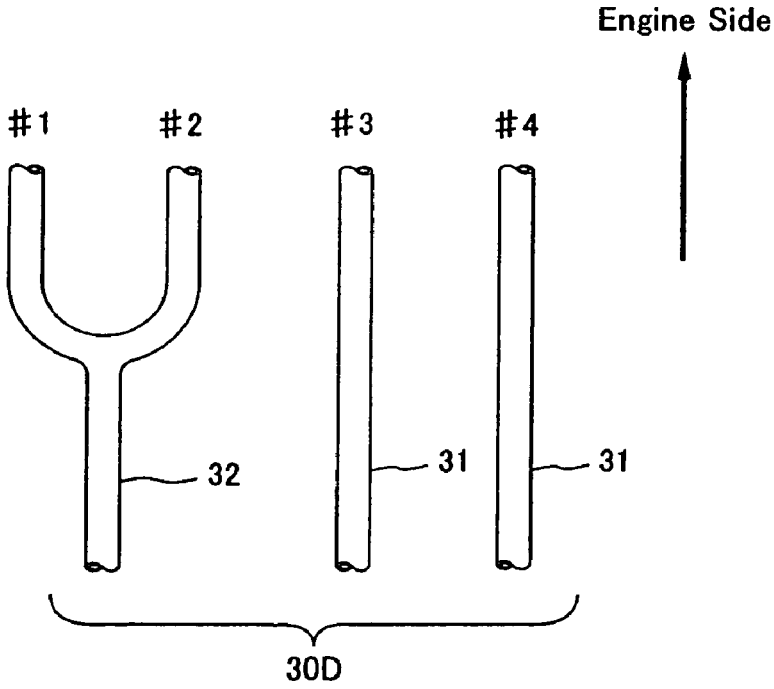
FIG. 6B is a schematic view showing another example of a configuration of the exhaust pipes suitable for the engine of the motorcycle shown in FIG. 1.

Further, another example of an exhaust pipe assembly 30D shown in FIG. 6B has a configuration that the collecting pipe 32 is connected to No. 1 and No. 2 cylinders (#1, #2) that do not carry out the simultaneous combustion, and the straight exhaust pipes 31 are connected to No. 3 and No. 4 cylinders (#3, #4). According to this configuration, exhaust pulsations of non-180 degree can be utilized for at least No. 1 and No. 2 cylinders (#1, #2) even for either of the combustion patterns of FIGS. 4B and 4C.

Figure 7:
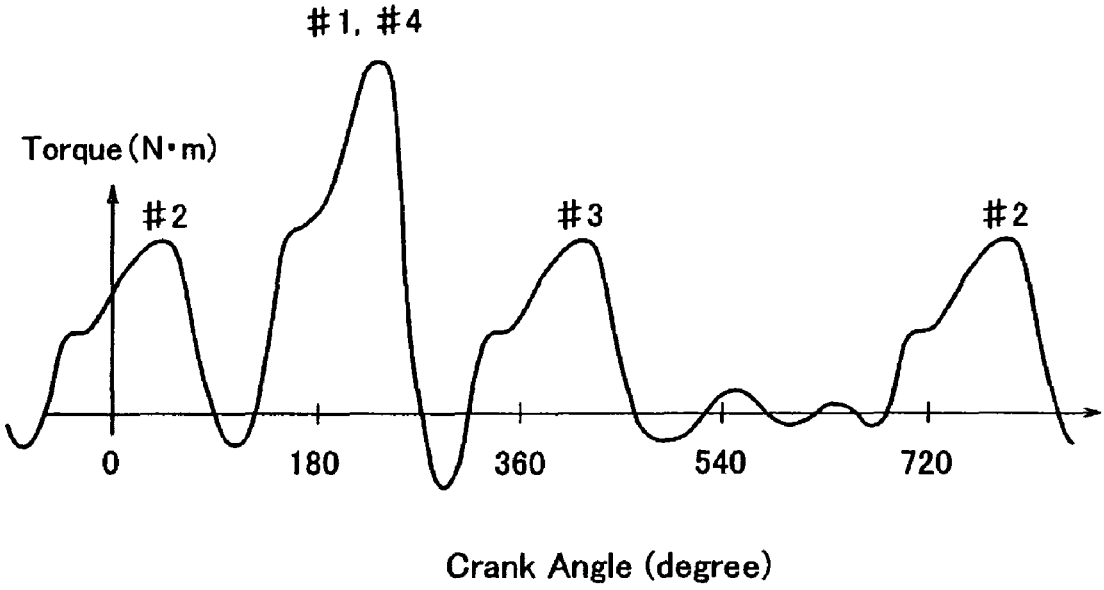
FIG. 7 shows still another example of a control pattern by the combustion control device according to the embodiment of the present invention.

FIG. 7 shows still another combustion pattern. This combustion pattern is such that a combustion of No. 2 cylinder (#2) is carried out when the crank phase angle is 0 degrees, combustions of No. 1 and No. 4 cylinders (#1, #4) are carried out at 180 degrees, a combustion of No. 3 cylinder (#3) is carried out at 360 degrees, no combustion is carried out for any of the cylinders at 540 degrees, and the pattern is repeated from the combustion of No. 2 cylinder (#2).

An example of an exhaust pipe assembly 30E suitable for the combustion pattern shown in FIG. 7 has a configuration that the straight exhaust pipe 31 is connected to No. 1 cylinder (#1) that carries out the simultaneous combustion with No. 4 cylinder (#4), and a collecting pipe 33 is connected to No. 2 through No. 4 cylinders (#2, #3, and #4) that do not carry out the simultaneous combustion. First, the collecting pipe 33 of this example collects No. 2 and No. 3 cylinders (#2, #3) and, then, further collects No. 4 cylinder (#4) on the more downstream side. Further, the straight exhaust pipe 31 is arranged on either of the left and right sides of the motorcycle body, and the collecting pipe 33 is arranged on the other side. In the meantime, in FIG. 8, a center line 10*c* of the motorcycle body is schematically shown by an one-point chain line. The straight exhaust pipe 31 is arranged on the left side of the body (exit left), and the collecting pipe 33 is arranged on the right side of the body (exit right).

Figure 8:
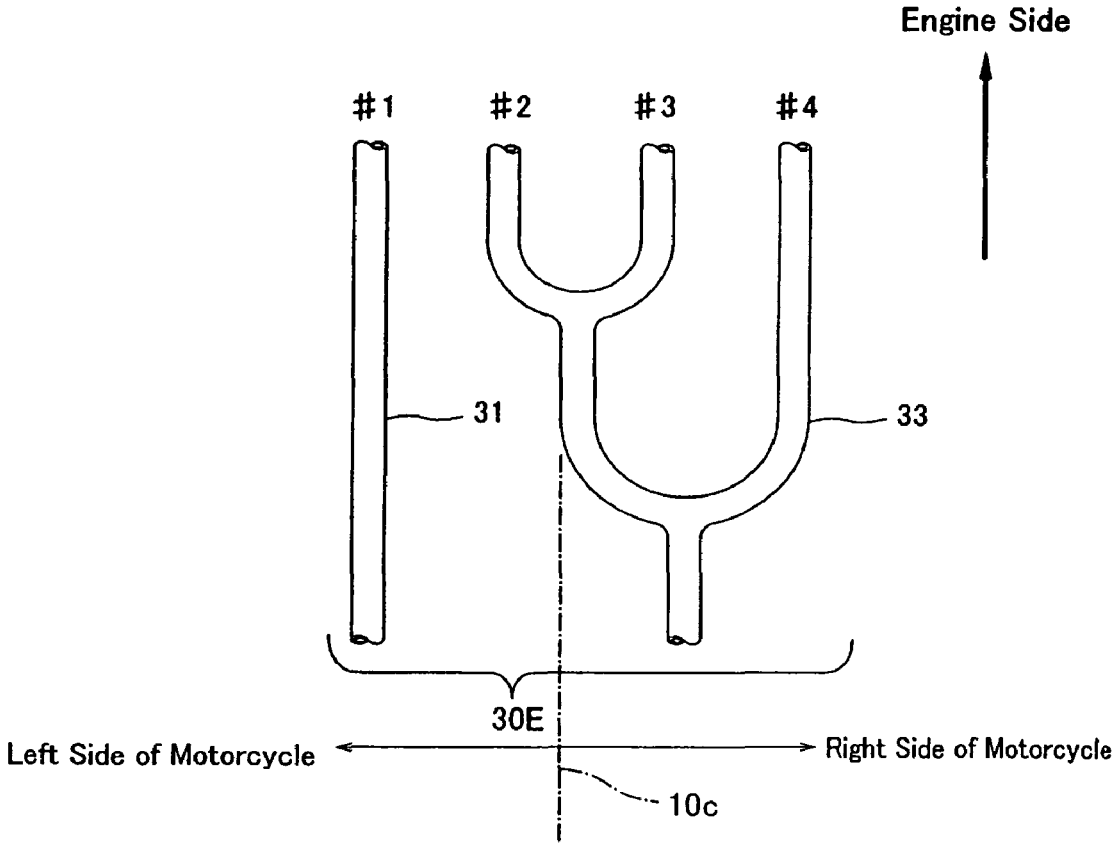
FIG. 8 is a schematic view showing a configuration of the exhaust pipes suitable for the control pattern shown in FIG. 7.

Further, in FIG. 8, it is also possible to further collect the collecting pipe 33 that collects No. 2, No. 3, and No. 4 cylinders (#2, #3, and #4) with the straight exhaust pipe 31 being connected to No. 1 cylinder (#1), and to arrange the collected pipe on either of the left and right sides of the motorcycle body.

Figure 9:
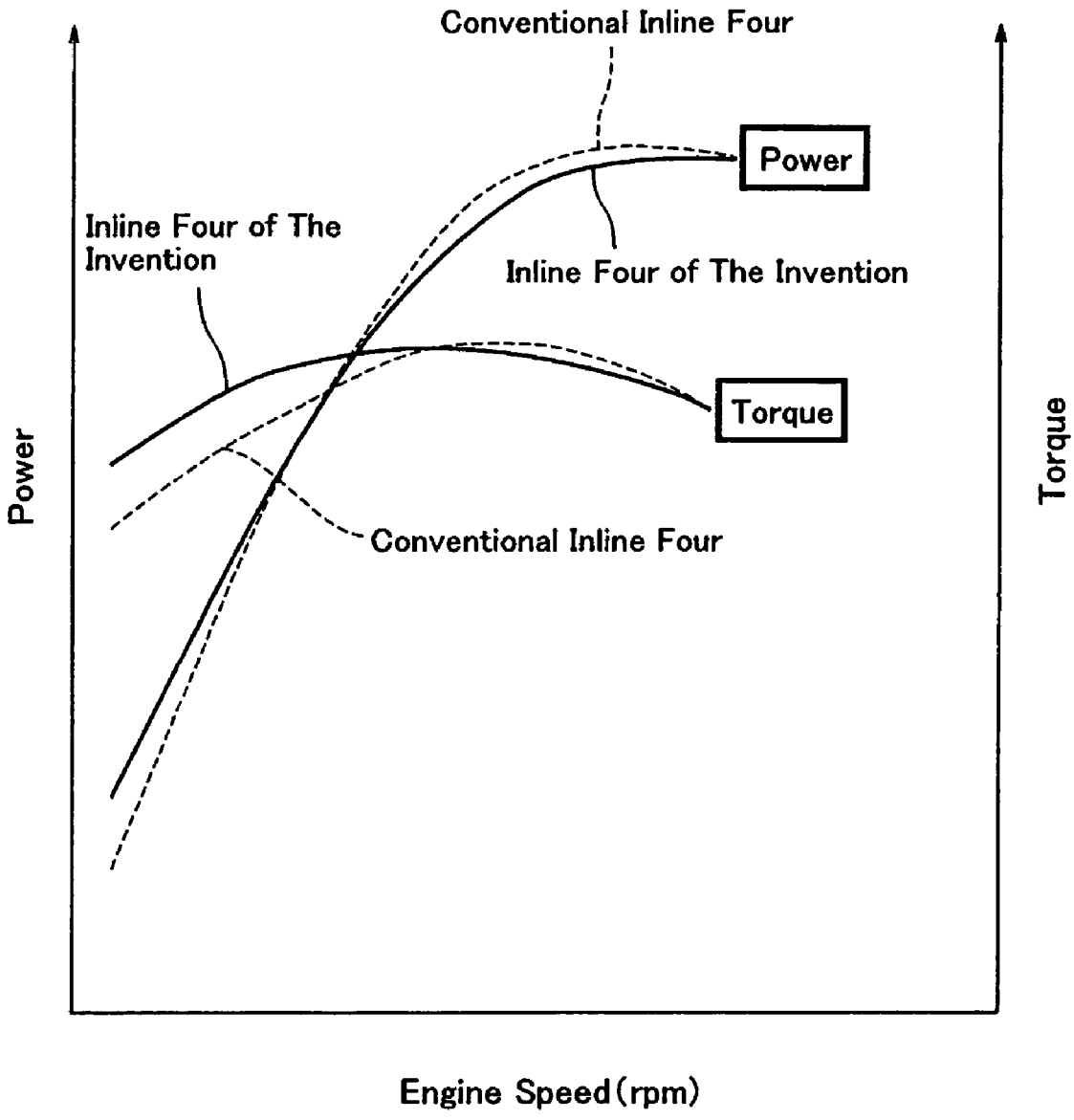
FIG. 9 is a graph showing an engine output (power) and torque characteristics by the combustion control device according to the embodiment of the present invention, where the vertical axis represents the engine output and torque and the horizontal axis represents an engine speed, respectively.

FIG. 9 shows a relationship between an output (power) and torque corresponding to an engine speed under a control according to the combustion pattern of the simultaneous combustion shown in FIG. 7, while comparing with a control under the combustion pattern of the conventional equally-intervalled combustion. In FIG. 9, the output and torque under the control according to the combustion pattern of the equally-intervalled combustion are shown by dashed lines, and the output and torque under the control according to the combustion pattern of the simultaneous combustion are shown by solid lines, respectively. As shown in FIG. 9, it can be seen that the output and torque in a low-speed region have been improved by the simultaneous combustion.

Figure 10:
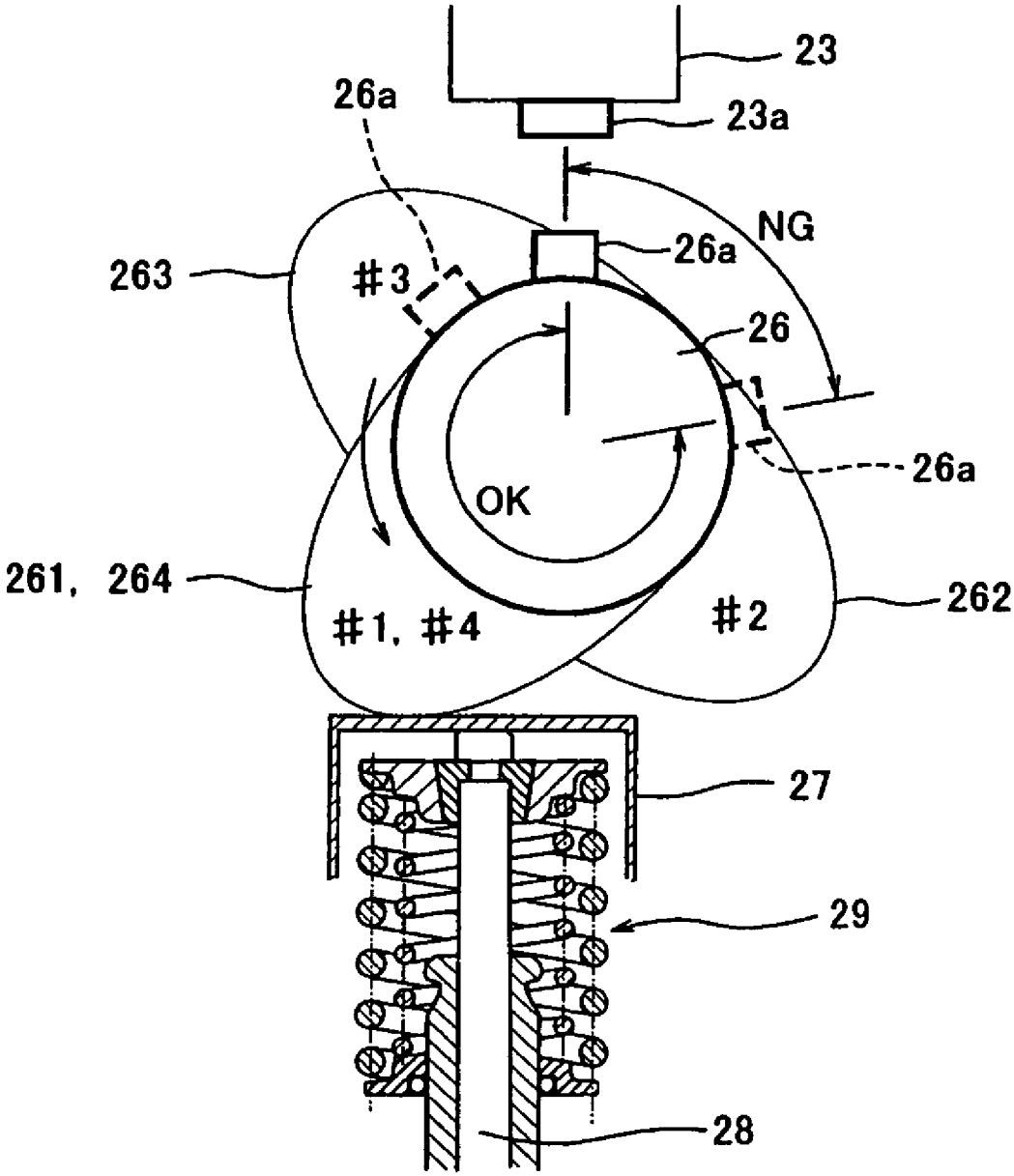
FIG. 10 is a schematic view showing an installation position of a detection point of a cam sensor suitable for the combustion control device shown in FIG. 3.

Further, the following configuration may be additionally provided. Referring to FIG. 10, a reference numeral 26 represents the camshaft of the engine 20 (see FIG. 1) configured so that No. 1 and No. 4 cylinders (#1, #4) carry out the simultaneous combustions. In the meantime, although it is configured so that No. 1 and No. 4 cylinders (#1, #4) carry out the simultaneous combustions, this method may be similarly applicable even to the configuration that other cylinders carry out the simultaneous combustions. Further, this camshaft 26 may be applicable to either the air-intake or exhaust side.

When the camshaft 26 rotates in the direction of an arrow, and the cams 262, 263 corresponding to No. 2 or No. 3 cylinder (#2, #3) pushes the respective tappet 27 for valves 28 of the engine, the cams 262, 263 do not push the tappets 27 at the same time. However, when the cams 261, 264 corresponding to No. 1 and No. 4 cylinders (#1, #4) push the respective tappets 27, since two tappets 27 are pushed simultaneously, a biasing force of springs 29 of these tappets 27 are doubled, the valves 28 may not be pushed smoothly, and, thus, the rotation of the camshaft 26 itself may become unstable.

Accordingly, while the cams corresponding to the cylinders that carry out the simultaneous combustions are in contact with the tappets 27, where a detecting portion 23*a* of the cam sensor 23 is typically configured such that it outputs a pulse signal when it passes a detection point 26*a* of the cam sensor 23 that is provided at a position on the circumference of the camshaft 26, the pulse signal may become unstable. Therefore, it is desirable to determine the installation position of the detection point 26*a* of the cam sensor 23 other than such a position of the circumference of the camshaft 26.

Typically, the camshaft 26 has a relationship in which it carries out one revolution while the crankshaft 21 carries out two revolutions. In this embodiment, the cam sensor 23 is provided to determine whether the crankshaft 21 that carries out two revolutions during one combustion cycle is in the first revolution or in the second revolution.

In the meantime, in order to clarify the explanation herein, a configuration in which the detection point 26*a* is provided at one position on the circumference of the camshaft 26 is illustrated. However, by the similar principle, the detection point 26*a* may also be provided on a suitable extended shaft that is directly or indirectly connected with the camshaft 26, or an arbitrary mechanism coupled to the camshaft 26 or the extended shaft through a gear train, etc.

Further, in FIG. 10, the detection point 26*a* is arranged so that it passes the detecting portion 23*a* immediately before the cam 261 and 264 corresponding to No. 1 and No. 4 cylinders (#1, #4) push the corresponding tappets 27. Therefore, in FIG. 10, the detection point 26*a* should not be provided within an angle range corresponding to the time from when the cams 261 and 264 start pushing the tappets 27 until when the cams 261 and 264 stop pushing the tappets 27, and, therefore, the angle range is shown as an "NG" range. That is, the detection point 26*a* may be provided in any angle positions other than this "NG" range, and, therefore, it is shown as an "OK" range.

Figure 11:
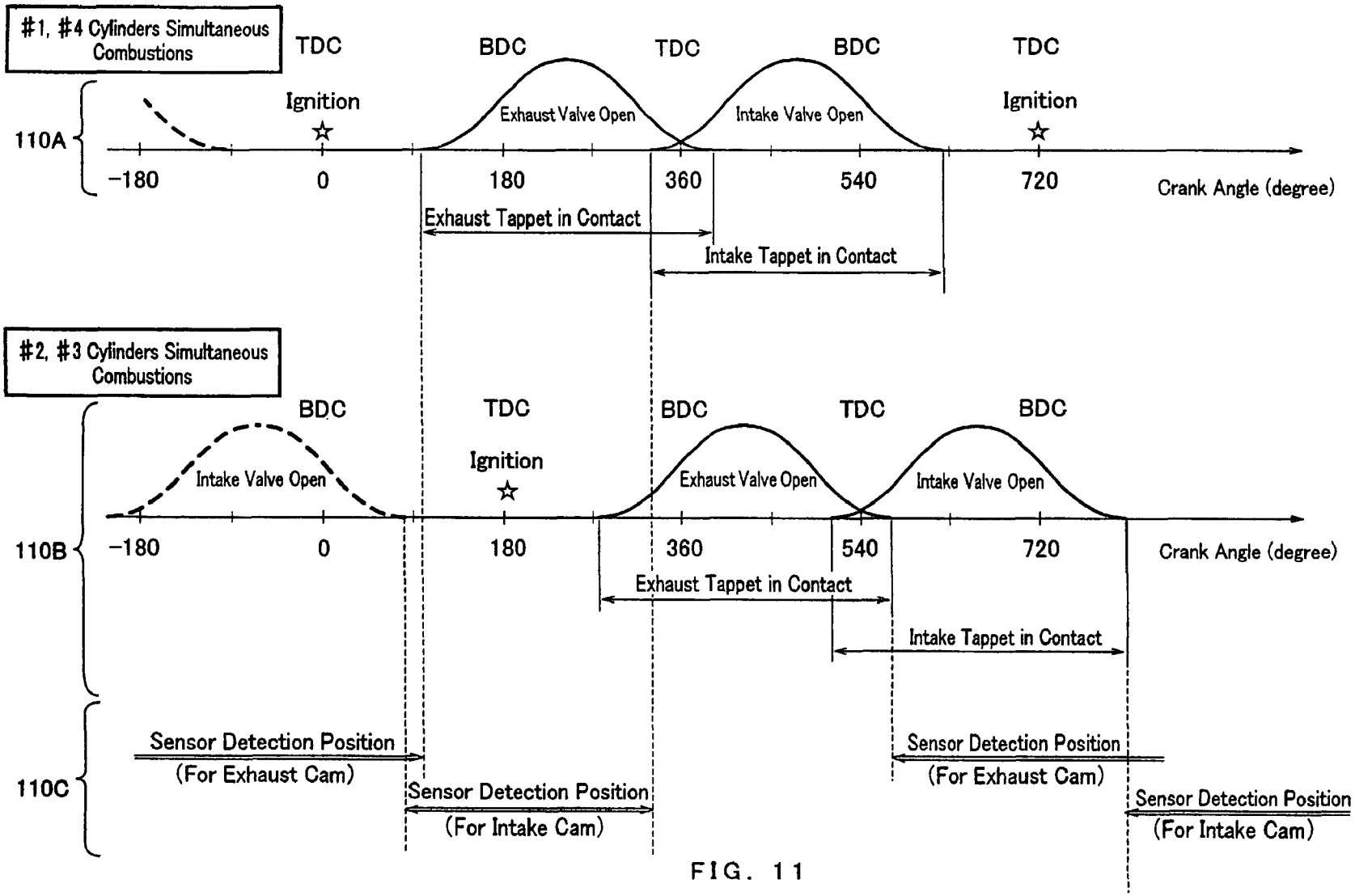
FIG. 11 is a graph for explaining the installation position of the detection point of the cam sensor shown in FIG. 10.

110A and 110B in FIG. 11 represent displacements of air-intake valves and exhaust valves according to the crank angle (the crank phase angle). Especially, 110A represents the case where No. 1 and No. 4 cylinders (#1, #4) are configured to carry out the simultaneous combustions, and 110B represents the case where No. 2 and No. 3 cylinders (#2, #3) are configured to carry out the simultaneous combustions, respectively.

As shown in 110A of FIG. 11, intake strokes of No. 1 and No. 4 cylinders (#1, #4) stretch from 360 degrees to 630 degrees in the crank angle, and, typically, air-intake valves open from 320 degrees to 620 degrees in the crank angle, that is, it is a state where the cams on the air-intake side contact the tappets. Ignitions are carried out at 720 degrees (=0 degrees) in the crank angle, an exhaust stroke stretches from 90 degrees to 360 degrees in the crank angle, and, typically, exhaust valves open from 100 degrees to 400 degrees in the crank angle, that is, it is in a state where the cams on the exhaust side contacts the tappets.

In the case where these No. 1 and No. 4 cylinders (#1, #4) are the only cylinders that are intended to carry out the simultaneous combustions, and where the cam sensor 23 is provided on the air-intake side of these cylinders, the detecting portion 23*a* may be provided anywhere from 620 degrees to 320 degrees for the stable pulse signals as mentioned above.

Similarly, if the cam sensor 23 is provided on the exhaust side of these cylinders, the detecting portion 23*a* may be provided anywhere from 400 degrees to 100 degrees.

As shown in 110B of FIG. 11, an intake stroke of No. 2 and No. 3 cylinders (#2, #3) stretches from 540 degrees to 810 degrees (=90 degrees) in the crank angle, and, typically, the air-intake valves open from 500 degrees to 800 degrees (=80 degrees) in the crank angle, that is, it is in a state where the cams on the air-intake side contact the tappets. An ignition is carried out at 180 degrees in the crank angle, an exhaust stroke stretches from 270 degrees to approximately 540 degrees in the crank angle, and, typically, the exhaust valves open from 280 degrees to 580 degrees in the crank angle, that is, it is in a state where the cams on the exhaust side contact the tappets.

If these No. 2 and No. 3 cylinders (#2, #3) are the only cylinders that are intended to carry out the simultaneous combustions, and the cam sensor 23 is provided on the air-intake side of these cylinders, the detecting portion 23*a* may be provided anywhere from 800 degrees (=80 degrees) to 500 degrees for the stable pulse signals as mentioned above.

Similarly, if the cam sensor 23 is provided in the exhaust side of these cylinders, the detecting portion 23*a* may be provided anywhere from 580 degrees to 280 degrees.

Further, where it is a configuration that both No. 1 and No. 4 cylinders (#1, #4) and No. 2 and No. 3 cylinders (#2, #3) carry out the simultaneous combustions, and the cam sensor 23 is provided on the air-intake side of these cylinders, as shown in 110C of FIG. 11, the detecting portion 23*a* may be provided anywhere from 800 degrees (=80 degrees) to 320 degrees for the stable pulse signal as mentioned above, avoiding the time of the contact of the air-intake-side tappets of both No. 1 and No. 4 cylinders (#1, #4) and No. 2 and No. 3 cylinders (#2, #3).

Similarly, if the cam sensor 23 is provided on the exhaust side of these cylinders, the detecting portion 23*a* may be provided anywhere from 580 degrees to 100 degrees.

In the meantime, in the above-mentioned embodiment, although the cam sensor 23 as shown in FIG. 10 has been provided in an upper side, it will be appreciated that it may be provided any position as long as the above-mentioned relationship of the rotational angle position of the camshaft 26 is satisfied.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements and neither requiring, nor excluding two or more such elements. Other combinations and subcombinations of features, functions and elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A device for controlling combustions of an inline-four cylinder engine four pistons of cylinders per crankshaft, the device comprising:

a first module for causing simultaneous combustions of two cylinders of the four cylinders, when a crank phase angle becomes a predetermined crank phase angle, the two cylinders having a same phase angle of crank pins of the crankshaft; and a second module for causing a combustion of one of the other cylinders when the crank phase angle is offset by a first crank phase angle from the predetermined crank phase angle, and further causing a combustion of the remaining one cylinder of the four cylinders when the crank phase angle is offset by a second crank phase angle from the combustion of the one of the other cylinders;

wherein the first module repeats the simultaneous combustions of the two cylinders only at every 720 degrees of revolution of the crankshaft in a combustion stroke, when the crank phase angle is offset by a third crank phase angle from the crank phase angle which is added to a sum of the predetermined crank phase angle, the first crank phase angle and the second crank phase angle to return to the predetermined crank phase angle.

2. The combustion control device of claim 1, wherein the crankshaft is a flat crankshaft which crank phase angles of the crankshaft are 0 and 180 degrees.

3. The combustion control device of claim 1, wherein the two cylinders configured to perform simultaneous combustions are positioned at outer sides, and the other cylinders configured not to perform simultaneous combustions are positioned at inner sides in the inline-four cylinder engine.

4. The combustion control device of claim 2, wherein the engine includes pistons of four cylinders per crankshaft;

wherein the second module causes a combustion of the one of the other cylinders when the crank phase angle is offset by 180 degrees from the predetermined crank phase angle, and further causes a combustion of the remaining one cylinder of the four cylinders when the crank phase angle is offset by 360 degrees from the combustion of the one of the other cylinders; and wherein the first module repeats the simultaneous combustions of the two cylinders when the crank phase angle is offset by 180 degrees from the combustion of the remaining one cylinder of the four cylinders.

5. The combustion control device of claim 1, wherein combustions of corresponding cylinders are carried out based on a rotational angle position of a camshaft of the engine detected by a cam sensor with which the engine is equipped; and wherein a detection point of the cam sensor is arranged at another rotational angle position on the camshaft other than a rotational angle position corresponding to a timing during which cams on the camshaft corresponding to the cylinders that are carrying out the simultaneous combustions are contacting and pushing tappets for valves of the engine.

6. A motorcycle, comprising:

a four-cycle engine having three or more pistons of cylinders per crankshaft, the engine including an intake valve and an exhaust valve provided for each of the cylinders, wherein valves respectively provided in two of the cylinders are configured to operate in a same crank phase angle according to the revolution of the crankshaft, and valves respectively provided in cylinders other than the two cylinders are configured to operate in a crank phase angle different from the crank phase angle of the valves of the two cylinders according to the revolution of the crankshaft;

exhaust pipes connected to each cylinder of the engine; and a combustion control device for controlling combustions of the engine, and the combustion control device includes:

a first module for causing simultaneous combustions of the two cylinders of the three or more cylinders when the crank phase angle becomes a predetermined crank phase angle, the two cylinders having a same phase angle of crank pins of the crankshaft; and a second module for causing a combustion of at least one of the other cylinders, when the crank phase angle is offset by a first crank phase angle from the predetermined crank phase angle;

wherein the first module repeats the simultaneous combustions of the two cylinders in a combustion stroke, when the crank phase angle is offset by a second crank phase angle from the crank phase angle which is added to the predetermined crank phase angle and the first crank phase angle to return to the predetermined crank phase angle.

7. The motorcycle of claim 6, wherein the exhaust pipes connected to the cylinders that have the same crank phase angle are collected.

8. The motorcycle of claim 7, wherein the collected exhaust pipes are further collected with an exhaust pipe connected to the cylinder that is 180 degrees apart in the crank phase angle, at a location downstream of a collected position of the collected exhaust pipes.

9. The motorcycle of claim 6, wherein the exhaust pipes connected to the cylinders that are 180 degrees apart in the crank phase angle are collected.

10. The motorcycle of claim 9, wherein every two exhaust pipes are collected, and collected positions of the exhaust pipe pairs are offset in the longitudinal direction of the exhaust pipes.

11. A method of controlling combustions of an inline-four cylinder engine having four pistons of cylinders per crankshaft, the method comprising:

causing simultaneous combustions of two cylinders of the four cylinders when a crank phase angle becomes a predetermined crank phase angle, the two cylinders having a same phase angle of crank pins of the crankshaft;

causing a combustion of one of the other cylinders when the crank phase angle is offset by a first crank phase angle from the predetermined crank phase angle;

causing a combustion of the remaining one cylinder of the four cylinders when the crank phase angle is offset by a second crank phase angle from the combustion of the one of the other cylinders; and repeating the simultaneous combustions of the two cylinders only at every 720 degrees of revolution of the crankshaft in a combustion stroke, when the crank phase angle is offset by a third crank phase angle from the crank phase angle which is added to a sum of the predetermined crank phase angle, the first crank phase angle and the second crank phase angle to return to the predetermined crank phase angle.

12. The method of claim 11, wherein the two cylinders configured to perform simultaneous combustions are positioned at outer sides, and the other cylinders configured not to perform simultaneous combustions are positioned at inner sides in the inline-four cylinder engine.

13. The motorcycle of claim 6, wherein the engine is an inline-four cylinder engine;

wherein the first module causes simultaneous combustions of two cylinders of the four cylinders, the two cylinders being positioned at outer sides in the inline-four cylinder engine, when the crank phase angle becomes the predetermined crank phase angle;

wherein the second module causes a combustion of one of the other cylinders, the other cylinders being positioned at inner sides in the inline-four cylinder engine, when the crank phase angle is offset by a first crank phase angle, and further causes a combustion of the remaining one cylinder of the other cylinders when the crank phase angle is offset by a third crank phase angle from the combustion of the one of the other cylinders; and wherein the first module repeats the simultaneous combustions of the two cylinders in a combustion stroke, when the crank phase angle is offset by a fourth crank phase angle from the crank phase angle which is added to a sum of the predetermined crank phase angle, the first crank phase angle and the third crank phase angle to return to the predetermined crank phase angle.

14. The motorcycle of claim 7, wherein every two exhaust pipes are collected, and collected positions of the exhaust pipe pairs are offset in the longitudinal direction of the exhaust pipes.

15. The motorcycle of claim 6, wherein the exhaust pipes include a straight exhaust pipe connected to one of the cylinders of the engine, and a collecting pipe connected to the other cylinders of the engine.

16. The motorcycle of claim 15, wherein the straight exhaust pipe is arranged on a left side of a body of the motorcycle, and the collecting pipe is arranged on a right side of the body.

* * * * *